US010926160B2

(12) United States Patent
Micacchi

(10) Patent No.: US 10,926,160 B2
(45) Date of Patent: Feb. 23, 2021

(54) DEVICE FOR SKATING AND RELATED METHOD OF FUNCTIONING

(71) Applicant: MOHAWKNEE S.R.L., Rieti (IT)

(72) Inventor: Nicola Micacchi, Rieti RI (IT)

(73) Assignee: MOHAWKNEE S.R.L., Rieti (IT)

( * ) Notice: Subject to any disclaimer, the term of this patent is extended or adjusted under 35 U.S.C. 154(b) by 0 days.

(21) Appl. No.: 16/220,579

(22) Filed: Dec. 14, 2018

(65) Prior Publication Data

US 2019/0184265 A1 Jun. 20, 2019

(30) Foreign Application Priority Data

Dec. 15, 2017 (IT) ..... 102017000145045

(51) Int. Cl.

| | |
|---|---|
| ***A63C 17/12*** | (2006.01) |
| ***A63C 17/01*** | (2006.01) |
| ***A63C 17/14*** | (2006.01) |
| ***A43B 3/00*** | (2006.01) |

(52) U.S. Cl.

CPC ..... *A63C 17/12* (2013.01); *A43B 3/0005* (2013.01); *A63C 17/015* (2013.01); *A63C 17/14* (2013.01); *A63C 2203/12* (2013.01); *A63C 2203/18* (2013.01); *A63C 2203/22* (2013.01); *A63C 2203/24* (2013.01)

(58) Field of Classification Search

CPC ... A63C 17/12; A63C 17/015; A63C 2203/12; A63C 2203/18; A63C 2203/22; A63C 2203/24; A43B 3/0005

See application file for complete search history.

(56) References Cited

U.S. PATENT DOCUMENTS

| | | | | |
|---|---|---|---|---|
| 6,050,357 | A | 4/2000 | Staelin et al. | |
| 9,607,506 | B1 * | 3/2017 | Manning | G08C 17/02 |
| 10,160,503 | B1 * | 12/2018 | Zheng | B62D 51/02 |
| 10,293,243 | B1 * | 5/2019 | Doerksen | A63C 17/08 |
| 2001/0032743 | A1 * | 10/2001 | Kamen | A63C 17/12 180/7.1 |

(Continued)

FOREIGN PATENT DOCUMENTS

WO 20140107653 7/2014

OTHER PUBLICATIONS

European Serach Report issued by the EPO for Italian priority application No. IT201700145045 dated Oct. 26, 2018.

*Primary Examiner* — Erez Gurari

(57) ABSTRACT

Skating device (1) provided with a plurality of wheels (2*a*, 2*b*, 2*c*, 2*d*), comprising:

an electric motor (3) operatively coupled with at least one wheel (2*a*) of said plurality of wheels;

at least one acceleration sensor (4) operatively coupled with at least one wheel (2*a*) of said plurality of wheels (2*a*, 2*b*, 2*c*, 2*d*);

at least one speed sensor operatively coupled with at least one wheel (2*a*) of said plurality of wheels (2*a*, 2*b*, 2*c*, 2*d*); and at least one control unity adapted to actuate the operations of said electric motor (3) at least when said acceleration sensor (4) detects positive acceleration of said at least one wheel (2*a*), wherein the amount of electric power supplied by said electric motor to said at least one wheel (2*a*) is calculated according to the speed measured by said at least one speed sensor (5), at least when said acceleration sensor (4) detects said positive acceleration.

13 Claims, 2 Drawing Sheets

(56) References Cited

U.S. PATENT DOCUMENTS

2005/0121238 A1* 6/2005 Ishii ..... A63C 17/08 180/65.1
2005/0211078 A1* 9/2005 Iwai ..... A63C 5/06 84/723
2006/0027409 A1 2/2006 Adams et al.
2006/0260857 A1* 11/2006 Kakinuma ..... A63C 17/08 180/218
2007/0110278 A1* 5/2007 Vock ..... A63B 24/0003 382/103
2009/0120705 A1 5/2009 McKinzie
2010/0222941 A1* 9/2010 Chang ..... A63C 17/015 701/2
2013/0158759 A1* 6/2013 Oh ..... A63C 17/12 701/22
2013/0206493 A1* 8/2013 Larson ..... A63C 17/12 180/181
2013/0282216 A1* 10/2013 Edney ..... A63C 17/12 701/22
2014/0262574 A1* 9/2014 Rodgers ..... A63C 17/12 180/167
2015/0265906 A1* 9/2015 Takeuchi ..... A63C 11/227 280/821
2016/0136508 A1* 5/2016 Bigler ..... A63C 17/014 180/181
2016/0261731 A1* 9/2016 Doolin ..... A63C 17/12
2017/0182397 A1* 6/2017 Zhang ..... A63C 17/12
2017/0252638 A1* 9/2017 Ulmen ..... A63C 17/12
2018/0147478 A1* 5/2018 Wood ..... B60L 7/10
2018/0250581 A1* 9/2018 Lemire-Elmore ..... A63C 17/12
2019/0031047 A1* 1/2019 Cho ..... B60Q 9/00
2019/0061557 A1* 2/2019 Quick ..... B60K 7/0007
2019/0092387 A1* 3/2019 Ying ..... B62K 11/007
2019/0184265 A1* 6/2019 Micacchi ..... A43B 3/0005
2019/0254568 A1* 8/2019 Nino ..... A43B 3/0005
2019/0289950 A1* 9/2019 Matsumoto ..... G06F 9/542

* cited by examiner

DEVICE FOR SKATING AND RELATED METHOD OF FUNCTIONING

FIELD OF THE INVENTION

The present invention concerns a skating device and relative method of operation. In particular, a skating device is provided with a plurality of wheels and can be, for example, of the roller-skate type, in-line or classic, i.e. with two couples of wheels respectively arranged in the front and back, or a skateboard.

KNOWN PRIOR ART

Nowadays, there is a growing interest to provide unconventional, more sustainable from an environmental point of view, and more efficient means of transport. Two main problems must be addressed to approach this topic: the identification of the best propulsion scheme and the management thereof. Electric mobility has been widely tested, but the management of the torque to be supplied at the electric motor combined with the means of transport is still a problem far from being solved.

Many attempts were made with the aim to combine small motors and personal vehicles. Recently, an attempt concerned the use of an actuator with a pressure sensor underneath the foot, mounted on a skateboard as described in the US patent US20130206493A1, has been made. In recent years, fast balancing controls using gyroscopes, such as developed by Segway®, were added, launching a family of electrically driven skateboards with and without a handle, also known under the English term "gyropode," as described in document CN203186511U.

Also classic roller-skates and in-line skates were not exempt from attempts to provide auxiliary propulsion. The first solutions comprised motors that had to be carried on the shoulders of the skater. A solution comprising internal combustion engines is described in the U.S. Pat. No. 5,236,058.

A solution in which the electric motor is directly positioned on the frame of the skate is described in U.S. Pat. No. 3,876,032 as a preferred embodiment.

A shoe provided with sensors used to identify the position of the foot is described in WO2014/107653/A1. The shoe contains pressure sensors arranged on the heel and tip of the shoe, and a control unit that, depending on a specific algorithm, has the function of measuring the frequency of the steps and the position of the shoe, by analyzing the contact between the ground and the shoe itself. The sensors positioned on the heel and tip can also be used to make the shoe turn. The shoe also comprises an obstacle sensor whose role is to change the pace and to set in place safety procedures whenever an obstacle is detected in front of the user.

U.S. Pat. No. 605,037 describes an active control system installed on a skateboard, which comprises a controller, a weight sensor and a sensor to detect the presence of the foot and the position of the foot on the skateboard and to measure the distance between the feet.

Patent US2009/0120705/A1 describes a shoe with retractable wheels, or wheels, that can be managed with a hand held device.

The present invention also considers an electric motor arranged on the frame of the skating device, in mechanical contact with at least one wheel preferably by means of a gear wheel transmission. The power to the motor is provided by one or more batteries arranged on the frame, or carried by the skater. Although the best propulsion system has been identified for decades, the problem of proper torque management still exists today, understood as the possibility to combine the thrust with the typical unstable posture of an individual positioned on a frame provided with wheels.

The increased wheel dimensions and the use of portable electric devices already suggested in the U.S. Pat. Nos. 3,876,032 and 7,204,330 were recently improved by the company Acton Rocketskates™ by adding controls by means of inclination sensors.

Anyway, all the solutions reported both for skates and skateboards transform the interaction between man and vehicle and create an entirely new way of using them. In fact, it is sometimes impossible to lift the device off the ground. In practice, the skating approach is completely lost. The skateboard and skates therefore become electrically driven vehicles where human impulse plays the crucial role by means of force sensors or portable electronic devices.

In the aforesaid devices, the user therefore no longer skates or no longer makes the moves normally made with a skateboard, or with roller-skates on the feet, but is transported by the device itself without any effort.

Therefore, object of the present invention is to implement a skating device that allows the user to still enjoy the pleasure of being able to skate, with roller-skates (in-line or classic) or with a skateboard, while being simultaneously assisted in such process.

A further object of the present invention is to implement a skating device that is both simple to make and structurally less complex than the ones of the known art.

Finally, object of the present invention is to achieve a method for the operations of a skating device that allows to overcome the aforesaid drawbacks of the skating devices of the known art.

SUMMARY OF THE INVENTION

The aforesaid objects are achieved by a skating device provided with a plurality of wheels and that comprises an electric motor operatively coupled with at least one wheel of said plurality of wheels, at least one acceleration sensor operatively coupled with at least one wheel of said plurality of wheels to detect positive acceleration thereof following a thrust performed by the user on said skating device, at least one speed sensor operatively coupled with at least one wheel of said plurality of wheels to measure the speed of said skating device, and at least one control unit adapted to actuate the operations of said electric motor at least when said acceleration sensor detects said positive acceleration of said at least one wheel, wherein the amount of electric power supplied by said electric motor to said at least one wheel is calculated according to the speed measured by said at least one speed sensor, at least when said acceleration sensor detects said positive acceleration. The speed measurement can be carried out in a more precise manner, also by inputting the diameter of said at least one wheel coupled with said at least one speed sensor in the control unit.

Therefore, in practice, according to the afore described solution, in the event of coupling of an electric motor with a skating device of the in-line or classic type, or a skateboard, the concept of applying the driving force supplied to one or more wheels, following the actuation of sensors directly actuated by the skater, is entirely abandoned and replaced in favor of the assisted skating and indirect control of the skating concept. Assisted skating denotes a generation of small thrusts adapted to the skating conditions and provided when the user of the skating device is in the appropriate postural condition to receive them. In fact, the greatest challenge consists in balancing the force of propulsion and the typical unstable posture of an individual positioned on a wheeled device. The crucial assumption of the present invention consists in assuming that the supply of the driving torque at the electric motor is applied when the skater produces the typical forward thrust to skate, finding the user in a forward position with all of the weight loaded on the leg driving the skating. In case of the skateboard, the driving torque at the electric motor is applied when the user is with the feet on the board again, after having pushed with one foot on the ground, to the side of the skating device.

In order to achieve this result, an acceleration sensor, or accelerometer, coupled with at least one wheel of the skating device is necessary for exactly identifying the exact moment in which the skater, or user, produces the aforesaid forward thrust, therefore producing positive acceleration.

In order to give the right amount of kinetic energy, a speed sensor and a logic to bring this value back to the revolutions of the wheel are however necessary. The dimension of the diameter of the wheel must be an input variable. The electric motor will apply a torque modulation by using the speed value measured at the moment positive acceleration is detected by the control unit as a reference.

Moreover, advantageously, the thrust latency and/or thrust length and/or thrust intensity of said electric motor, and the minimum speed for actuating the operations of said electric motor, are parameters the user can set.

For a better adaptation of the assistance to the skating style, some parameters must be left to be set by the user. A small latency can optionally be entered by the user (thrust latency: SHORT; MEDIUM, LONG). Also the supply of power intended as length can be set by the user (thrust length: SHORT; MEDIUM, LONG).

It should be noted that thrust latency here and hereunder denotes the time interval between the moment the positive thrust acceleration of the user is detected by the acceleration sensor and the moment the driving torque is supplied at the electric motor.

The scale suggested, composed of three values, is not the only possible one. The optimal driving force calculated can optionally be increased by the user (thrust intensity: SHORT; MEDIUM, LONG). Also in this case, the scale suggested, composed of three values, is not the only possible one. Moreover, it should be noted that the speed sensor is also necessary for calculating a window during which the assisted skating is available. A lower cut avoids non required thrusts in a rest condition before the deactivation and can be left as an option set by the user: a high cut appears necessary for limiting the speed, respecting a possible limit set by the Regulatory Bodies.

This arrangement requires that the wheeled device, in particular the control unit, be equipped with electronic components such as controllers, ROM, RAM with preloaded software to manage the data of the sensors and the electric signals from the electric motor, by generating appropriate actuation commands according to the operation suggested.

Still according to the invention, said skating device comprises means for the wireless connection, for example of the wi-fi or Bluetooth® type, of said control unit to a remote device with a dedicated application and/or to other control unit of a further skating device.

This remote device comprises an external server and a device for transmitting/receiving data with said skating device and/or a further skating device. Obviously, also the wireless connection means, wireless or Bluetooth® or other protocol, comprise an antenna to be able to communicate with said remote device by means of the transmission/reception device.

The remote device can comprise a computer or a smartphone or the like.

The wireless connection, wi-fi or Bluetooth®, appears to be an essential requisite for the solution suggested in order to access the control system of the control unit by means of a remote application. The wireless connection allows to always maintain the skating device connected to the external server and, using a continuous exchange of data, it is possible to implement optimized metrics, by allowing, for example, that only one wheeled device of the two on the feet of the user is assisted.

According to the invention suggested, a skating system that comprises two skating devices of the type comprising two roller-skates and a remote device with a dedicated application is suggested. These roller-skates each comprise means for the wireless connection, wi-fi or Bluetooth®, of the respective control unit to such remote device with a dedicated application by means of which it will also be possible, for example, to set said latency, intensity and length values and to check the charge status of the batteries. Moreover, the wireless connection means, wi-fi or Bluetooth®, of the two skating devices can communicate with one another to manage skating parameters (for example the status of the device with respect to the assistance, i.e. the thrust latency, intensity and speed, etc.) in real time.

Moreover, the skating device comprises a supporting frame, wherein said at least one electric motor is arranged on said supporting frame, and gear wheel transmission means for the direct or indirect mechanical coupling between said at least one wheel and the drive shaft of said at least one electric motor. In practice, an appropriate revolution adapter, preferably of the gear wheel type, is arranged between the wheel and the drive shaft of the electric motor.

Moreover, still according to the invention, the skating device comprises one or more batteries to be housed on said supporting frame for supplying at least said electric motor, said control unit, said speed sensor and said acceleration sensor.

Furthermore, said skating device comprises first means for regenerating said one or more batteries. Said first regeneration means are operatively combined with one or more of said wheels.

In fact, the possibility to fully monitor the entire system composed of two wheeled devices, in case of roller-skates, can lead to an optimal battery regeneration process in the wheels, whether or not involved in the assistance.

According to a further embodiment of the invention, the skating device comprises a braking system provided with second means for regenerating said one or more batteries.

The skating device according to the invention comprises a roller-skate, or a skateboard.

The aforesaid objects are also achieved by a method of operation of a skating device according to one or more of claims 1 to 8, comprising the steps of:

a. detecting the positive acceleration of at least one wheel of said skating device;

b. measuring the speed achieved by said skating device, at least when positive acceleration of said skating device is detected during said step a) of the method;

c. supplying, by means of said electric motor, electric power to said at least one wheel, calculated according to the speed measured during said step b).

In particular, said step c) is carried out only if said speed measured during said step b) falls within a predetermined speed window.

Moreover, the latency time and/or thrust length supplied by the electric motor to at least one wheel and/or the thrust intensity for supplying said electric power of said electric motor and/or the minimum speed for actuating the operations of said electric motor during said step c) are parameters the user can set.

Still according to the method, said thrust intensity is selected so that to develop a torque at the electric motor so that to increase, maintain constant or decrease the speed of said skating device with respect to the speed measured in said step b) of the method. Preferably, the thrust intensity is selected so that to develop a torque at the electric motor so that to maintain constant, for a given period of time, the speed of said skating device with respect to the speed measured in said step b) of the method.

Finally, the method comprises the step of d) braking said wheeled device. Preferably, the method further comprises the step of e) regenerating said one or more batteries during said braking step d).

Alternatively or in combination with said step e), said method comprises the step of e') regenerating said one or more batteries by the rotation of one or more wheels.

BRIEF DESCRIPTION OF THE FIGURES

These and other aspects of the present invention will become clearer by the following detailed description of a preferred embodiment provided herein by way of example only and without limitations, with reference to the accompanying figures, in which.

With reference to the figures above, a skating device 1 according to the invention is depicted.

Figure 1:
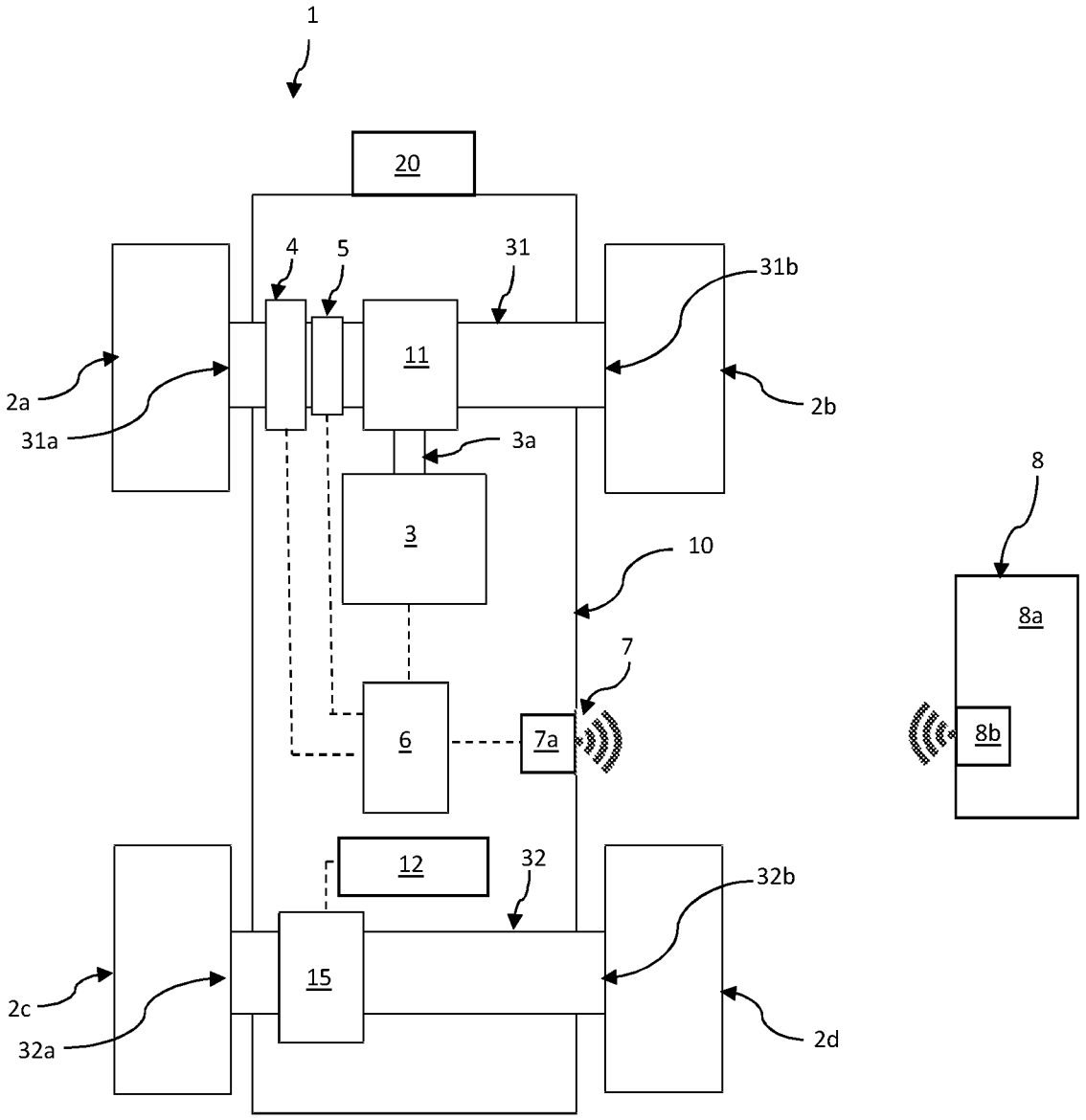
FIG. 1 shows a schematic top view of the skating device according to the invention.

As briefly shown in FIG. 1, the skating device 1, which in the specific case is of the roller-skate type provided with four wheels 2*a*, 2*b*, 2*c*, 2*d* coupled by two to two distinct rotation axes 31 and 32. Therefore, in a known way, the first rotation axis 31 comprises, at its ends 31*a* and 31*b*, the wheels 2*a* and 2*b*, respectively, whereas the second axis 32 comprises, at its ends 32*a* and 32*b*, the wheels 2*c* and 2*d*, respectively, the device 1 comprises an electric motor 3 of the direct current type, indirectly coupled with the two wheels 2*a* and 2*b* and the first axis 31 of the skating device 1. This electric motor 3 is adapted to generate assisted skating understood as a set of control functions and actuation commands implemented with dedicated circuitry and preloaded programs so that to produce thrusts adapted to the skating conditions of the user and generated exactly when the user is in the appropriate posture for receiving them.

It should be noted that a skating device that also only has three wheels, or five in a row, would anyhow fall within the scope of protection of the present invention.

The skating device 1 comprising an acceleration sensor 4 also coupled with the wheel 2*a* and, therefore, also with the wheel 2*b* that shares the same first axis 31 with the wheel 2*a*. The wheel 2*a* is in turn operatively coupled with the electric motor 3. This acceleration sensor 4 is useful in distinguishing, by means of a predetermined positive acceleration, either the stride of the skater, i.e. the forward thrust for skating, after which, as will be better explained below, the power from the electric motor 3 to the wheel 2*a* is supplied when the skater is in a forward position with all of the weight loaded on the leg driving the thrust, or, if a skateboard is used, the thrust of the user at the side of the skateboard on the ground.

Moreover, the skating device 1 comprises a speed sensor 5, also operatively coupled with the wheel 2*a* or with the wheel 2*b* of the device 1, which is used to calculate the exact amount of electric power supplied by the electric motor 3. The diameter of the wheels 2*a*, 2*b*, 2*c* and 2*d*, identical for all, can be entered as an input parameter of the control unit 6. Finally, the skating device 1 comprises a control unit 6 adapted to actuate the operations of the electric motor 3, at least when the acceleration sensor 4 detects positive acceleration of the wheel 2*a* with which it is coupled. The amount of electric power supplied by the electric motor 3 to the wheel 2*a* with which it is operatively coupled is calculated according to the speed measured by the speed sensor 5, at least when the acceleration sensor 4 detects the aforesaid positive acceleration. As stated above the diameter of the wheel 2*a*, with which the speed sensor 5 is operatively coupled, can be provided to improve the speed measurement.

Although here and hereunder, both the acceleration sensor 4 and the speed sensor 5 are coupled with the same wheel 2*a* with which the electric motor 3 is coupled, it should be noted that in an alternative embodiment not shown herein, the acceleration sensor 4 can be coupled with a wheel, for example the wheel 2*a*, different than the wheel 2*c* with which the speed sensor 5 could be coupled, without however departing from the scope of protection of the present invention.

According to the invention, the thrust latency and/or thrust length and/or thrust intensity of the electric motor 3, and the minimum speed for actuating the operations of the electric motor 3, the speed being detected by the speed sensor 4, are parameters the user can set. This allows the skating assistance to be adapted to the user on the basis of his preferences.

Moreover, the skating device 1 comprises means 7 for the wi-fi connection of the control unit 6 to a remote device 8 with a dedicated application. This remote device 8 comprises a server 8*a* and an antenna 8*b* for the transmission/reception of data. This allows to select the aforesaid parameters available to the user and, possibly, to download information in/from the control unit 6. The skating device 1 also comprises an appropriate antenna 7*a* for the reception and transmission of data towards the remote device 8.

In other embodiments, the communication means 7 can be of the Bluetooth® type, anyhow wireless, without however departing from the scope of protection of the present invention.

Figure 2:
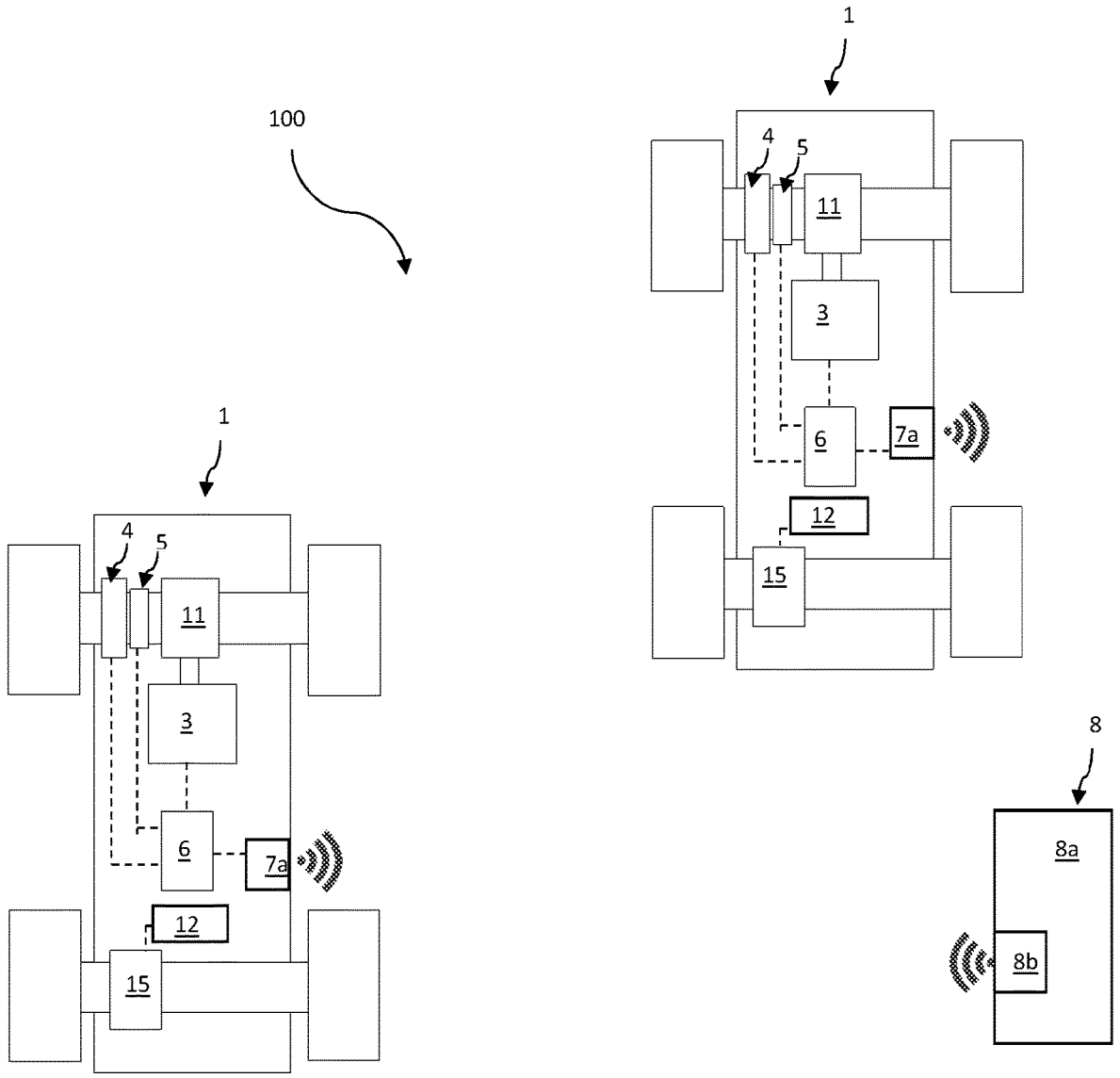
FIG. 2 shows a schematic top view of the skating system according to the invention.

A skating system 100 that comprises two skating devices 1 of the type comprising two roller-skates is shown in FIG. 2. These roller-skates 1 each comprise means 7 for the wireless connection of the respective control unit 6 to a remote device 8 with a dedicated application. The wireless connection means 7, for example wi-fi, of the two skating devices 1 communicate with one another while the user is skating to exchange information on the status of the device, i.e. on the skating assistance received (latency time, thrust intensity, thrust length, etc.), speed of each skate, thrust latency, length and other values.

In other embodiments not described in detail herein, the connection between the skating device 1 and the remote device 8, or between two skating devices 1, can occur also by Bluetooth® connection means 7, without however departing from the scope of protection of the present invention.

Moreover, the skating device 1 comprises a supporting frame 10. The electric motor 3 is arranged on the supporting frame 10. Moreover, the skating device 1 comprises gear wheel transmission means 11 for the mechanical coupling between the wheel 2*a* and the drive shaft 3*a* of the electric motor 3. These gear means 11 comprise a revolution adapter that is in turn directly coupled with the first drive shaft 31 in turn coupled with two wheels 2*a* and 2*b*.

The skating device 1 comprises a battery 12 to be housed on the supporting frame 10 for supplying the electric motor 3, the control unit 6, the speed sensor 5 and the acceleration sensor 4. In order to favor the readability of the accompanying figures, the electric connections between the battery 12 and the aforesaid components are not shown in the accompanying figures, however, it is clear to the technician of the sector that the battery 12 will somehow be electrically connected to the electric motor 3, the control unit 6, the speed sensor 5 and the acceleration sensor 4, so that to be able to supply them appropriately.

Furthermore, the skating device 1 comprises first means 15 for regenerating the battery 12. These first regeneration means 15 are operatively combined with two wheels 2*c*, 2*d* not coupled with the electric motor 3. It should be noted that, in other embodiments of the patent not shown herein, these first regeneration means 15 can be operatively combined with only one wheel 2*c* not coupled with the electric motor 3, without however departing from the scope of protection of the present invention.

In other embodiments, the first regeneration means 15 are also coupled with the wheels coupled with the electric motor 3.

According to the invention, the skating device 1 can further comprise a braking system 20.

According to an embodiment not shown herein, the skating device 1 is provided with second means for regenerating the battery 12, which are connected to the braking system 20.

Although a skating device 1 of the classic skate type, i.e. with two couples of wheels arranged in the front and back of the skating device 1, has been described up to this point, this solution can however also be used with a skateboard.

The method of operation of the skating device 1 as described above is described below. This method comprises the steps of:

a. detecting the positive acceleration of at least one wheel 2*a* of the skating device 1 by means of the acceleration sensor 4;

b. measuring, by means of the measuring sensor 5, the speed achieved by the skating device 1, at least when positive acceleration of the skating device 1 is detected during the step a) of the method;

c. supplying, by means of the electric motor 3, electric power to the wheel 2*a* with which the electric motor 3 is coupled; wherein such electric power supplied is calculated according to the speed measured during step b) by the speed sensor 5 and, preferably, also according to the diameter of the wheel 2*a* coupled with the same speed sensor 5. This diameter value is entered as a parameter in the control unit 6.

In practice, when the user leans the skating device 1, i.e. the roller-skate, on the ground and generates a thrust with the leg, the acceleration sensor 4 detects positive acceleration. At this point, the speed sensor 5 is enabled to measure the speed of the skate 1. The control unit 6 then acquires the value of this speed and, depending on its value and, preferably, on the value of the diameter of the wheel 2*a* combined with the speed sensor 5, calculates the power that the electric motor 3 will have to provide to the wheel 2*a* coupled with the electric motor 3. It should be noted that the speed can be measured by the sensor 5 at any time, however, the speed used to calculate the power that the electric motor 3 will have to supply to the wheel 2*a* is the one acquired from the moment positive acceleration is detected.

Moreover, still according to the present invention, step c) is only performed if the speed measured during step b) by the speed sensor 5 falls within a predetermined speed window. This predetermined speed window is between 10 and 70 km/h, preferably between 20 and 60 km/h.

Moreover, the latency time and/or thrust length and/or thrust intensity for supplying the electric power of the electric motor 3 and/or the minimum speed for actuating the operations of the electric motor 3 during step c) are parameters the user can set.

Therefore, according to the invention, the user can select different assistance parameters. In practice, the supply of the electric power to the wheel 2*a* can last from a few tenths, such as for example 5 tenths, to a few seconds, such as for example 10 seconds, the latency, i.e. the delay from the moment the acceleration sensor 4 detects positive acceleration, can be selected between a zero second value to a 3-second value, while the thrust intensity can be selected so that to increase the speed of the skating device 1 of a few kilometers, or to maintain it constant with respect to the one measured from the moment the positive acceleration was detected, or to decrease it but according to a different gradient than the one there would be without any assistance and, therefore, with friction only.

Still according to the invention, the method comprises the step of d) braking the skating device 1.

Advantageously, the method further comprises the step of e) regenerating the battery 12 or batteries 12 in case of a plurality of them, during the step d) of the method, i.e. during the braking itself of the device 1, thanks to appropriate power regeneration means that exploit the braking force exerted by the user.

In alternative, the method comprises the step of e') regenerating the battery 12, or several batteries 12, by the rotation of the wheels 2*c* and 2*d* not coupled with the electric motor 3 during the skating of the wheeled device 1. In practice, the wheels would act like a classic alternator present in cars.

It should be noted that, in another embodiment not shown herein, the method comprises the step of e') regenerating the battery 12, or several batteries 12, by the rotation of the wheels 2*a* and 2*b* coupled with the electric motor 3 during the skating of the wheeled device 1, without however departing from the scope of protection of the present invention.

This regeneration method e') could also work in combination with the previously described regeneration method e).

The invention claimed is:

1. Skating system (100) comprising two skating devices (1) and at least one remote device (8), each skating device being provided with a plurality of wheels (2*a*, 2*b*, 2*c*, 2*d*) and comprising: —an electric motor (3) operatively coupled with at least one wheel (2*a*) of said plurality of wheels; —at least one acceleration sensor (4) operatively coupled with at least one wheel (2*a*) of said plurality of wheels (2*a*, 2*b*, 2*c*, 2*d*); —at least one speed sensor (5) operatively coupled with at least one wheel (2*a*) of said plurality of wheels (2*a*, 2*b*, 2*c*, 2*d*); —at least one control unit (6) adapted to actuate the operations of said electric motor (3) at least when said acceleration sensor (4) detects positive acceleration of said at least one wheel (2*a*), wherein the amount of electric power supplied by said electric motor to said at least one wheel (2*a*) is calculated according to the speed measured by said at least one speed sensor (5), at least when said acceleration sensor (4) detects said positive acceleration; means (7) for wireless connection of said control unit (6) to a remote device (8) with a dedicated application and/or to other control unit of a further skating device, a supporting frame (10), wherein said at least one electric motor (3) is arranged on said supporting frame; and one or more batteries (12) to be housed on said supporting frame for supplying power to at least said electric motor, said control unit, said speed sensor and said acceleration sensor; said two skating devices (1) being respectively combined with the right foot and the left foot of the user, wherein the wireless connection means (7) of said control unit (6) of said two skating devices (1) communicate with said remote device (8) by means of a dedicated application and/or between one another to exchange information on the status of the two devices (1), the level of the respective one or more batteries (12), the respective speed, and the thrust latency.

2. Skating system according to claim 1, characterized in that said skating device comprises first regeneration means (15) for regenerating said one or more batteries, said first regeneration means being operatively combined with one or more of said wheels.

3. Skating system according to claim 2, characterized in that said skating device comprises a braking system provided with second regeneration means for regenerating said one or more batteries.

4. Skating system according to claim 1, characterized in that said skating device comprises a roller-skate.

5. Method of operation of a skating system (100) according to claim 1, wherein said skating system comprises two skating devices (1) and at least one remote device (8) the method of operation of each skating device comprising the steps of:

a. detecting, by means of said acceleration sensor (4), the positive acceleration of at least one wheel (2*a*) of said skating device (1);

b. measuring, by means of said speed sensor (5), the speed achieved by said skating device (1), at least when positive acceleration of said skating device is detected during said step a) of the method;

c. supplying, by means of said electric motor (2), electric power to said at least one wheel (2*a*), calculated according to the speed measured during said step b);

wherein said two skating devices (1) being respectively combined with the right foot and the left foot of the user, wherein the wireless connection means (7) of said control unit (6) of said two skating devices (1) communicate with said remote device (8) by means of a dedicated application and/or between one another to exchange information on the status of the two devices (1), the level of the respective one or more batteries (12), the respective speed, the thrust latency.

6. Method according to claim 5, characterized in that said step c) is carried out only if said speed measured during said step b) falls within a predetermined speed window.

7. Method according to claim 6, wherein said thrust intensity is selected so that to develop a torque at the electric motor so that to increase, maintain or decrease the speed of said skating device with respect to the speed measure in said step b) of the method.

8. Method according to claim 7, wherein said thrust intensity is selected so that to develop a torque at the electric motor so that to increase, maintain or decrease the speed of said skating device with respect to the speed measured in said step b) of the method.

9. Method according to claim 5, characterized by comprising the step of d) braking said wheeled device.

10. Method according to claim 9, characterized by comprising the step of e) regenerating said one or more batteries during said step d) of the method.

11. Method according to claim 5, characterized by comprising the step of e') regenerating said one or more batteries (12) by the rotation of one or more wheels.

12. Skating system device according to claim 1, characterized in that the thrust latency and/or thrust length and/or thrust intensity of said electric motor (3), and/or the minimum speed for actuating the operations of said electric motor are parameters the user can set.

13. Skating system device according to claim 1, characterized in that said skating device comprises gear wheel transmission means (11) for the direct or indirect mechanical coupling between said at least one wheel (2*a*) and the drive shaft (3*a*) of said at least one electric motor (3).

* * * * *